US010631096B1

(12) United States Patent
Garcia Selva et al.

(10) Patent No.: US 10,631,096 B1
(45) Date of Patent: Apr. 21, 2020

(54) FORCE CANCELLING TRANSDUCER

(71) Applicant: Apple Inc., Cupertino, CA (US)

(72) Inventors: Jordi Antoni Garcia Selva, San Jose, CA (US); Andrew M Hulva, San Jose, CA (US); Anthony P Grazian, Mountain View, CA (US); Matthew A Donarski, San Francisco, CA (US); Onur I Ilkorur, Campbell, CA (US); Alexander V Salvatti, Morgan Hill, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/296,091

(22) Filed: Mar. 7, 2019

(51) Int. Cl.
*H04R 1/02* (2006.01)
*H04R 9/06* (2006.01)
*H04R 9/02* (2006.01)

(52) U.S. Cl.
CPC ..... *H04R 9/06* (2013.01); *H04R 9/025* (2013.01); *H04R 2400/11* (2013.01); *H04R 2460/11* (2013.01)

(58) Field of Classification Search
CPC ..... H04R 9/06; H04R 9/025
See application file for complete search history.

(56) References Cited

U.S. PATENT DOCUMENTS 4,472,605 A 9/1984 Klein
4,783,820 A * 11/1988 Lyngdorf ..... H04R 1/227 181/145
5,664,020 A 9/1997 Goldfarb et al.
6,628,790 B1 9/2003 Klein
6,985,593 B2 1/2006 Nichols
7,062,054 B2 6/2006 Nishikawa et al.
7,539,318 B2 5/2009 Onuma et al.
7,912,240 B2 3/2011 Madaffari et al.
8,290,198 B2 10/2012 Ogasawara et al.
9,203,137 B1 12/2015 Guterman et al.
10,110,991 B2 10/2018 Crosby et al.
2003/0048920 A1* 3/2003 Van Halteren ..... H04R 9/063 381/424
2004/0028254 A1* 2/2004 Bachmann ..... H04R 11/02 381/412
2005/0220320 A1* 10/2005 Kim ..... H04R 9/025 381/396

(Continued)

FOREIGN PATENT DOCUMENTS

DE 2608068 9/1977

*Primary Examiner* — Simon King
(74) *Attorney, Agent, or Firm* — Womble Bond Dickinson (US) LLP

(57) ABSTRACT

A transducer assembly having a frame; a dual diaphragm and voice coil assembly suspended from the frame, the dual diaphragm and voice coil assembly having a first diaphragm and a first voice coil attached thereto and a second diaphragm and a second voice coil attached thereto, wherein the first voice coil and the second voice coil are between the first diaphragm and the second diaphragm, and the first diaphragm and the second diaphragm are operable to move in opposite directions along an axis of vibration; a magnet assembly positioned within the frame, the magnet assembly having a first magnet and a second magnet positioned between the first diaphragm and the second diaphragm; and a rigid support member dimensioned to fixedly connect the magnet assembly to the frame.

20 Claims, 12 Drawing Sheets

(56) References Cited

U.S. PATENT DOCUMENTS

| | | | | |
|---|---|---|---|---|
| 2006/0002569 | A1 | 1/2006 | Dickie | |
| 2006/0093180 | A1* | 5/2006 | Kim | H04R 9/025 381/412 |
| 2006/0280321 | A1 | 12/2006 | Miura | |
| 2007/0098209 | A1* | 5/2007 | Setiabudi | H04R 9/063 381/420 |
| 2008/0044044 | A1* | 2/2008 | Madaffari | H04R 9/025 381/186 |
| 2008/0205686 | A1* | 8/2008 | Tagami | H04R 9/025 381/398 |
| 2009/0136065 | A1 | 5/2009 | Yano | |
| 2012/0057730 | A1* | 3/2012 | Fujise | H04R 17/00 381/190 |
| 2014/0211963 | A1 | 7/2014 | Dodd | |
| 2015/0110335 | A1 | 4/2015 | Telemaque | |
| 2015/0304748 | A1 | 10/2015 | Yamada | |
| 2016/0021441 | A1* | 1/2016 | Shao | H04R 9/10 381/412 |
| 2016/0119718 | A1* | 4/2016 | Yang | H04R 9/02 381/351 |
| 2016/0205479 | A1 | 7/2016 | Tomar | |
| 2017/0055069 | A1 | 2/2017 | Lee et al. | |
| 2017/0272866 | A1* | 9/2017 | Griffiths | H04R 1/323 |
| 2018/0014115 | A1 | 1/2018 | Crosby et al. | |
| 2018/0367919 | A1* | 12/2018 | Xiao | H04R 9/06 |

* cited by examiner

FORCE CANCELLING TRANSDUCER

FIELD

An aspect of the invention is directed to a force cancelling transducer, more specifically, a dual diaphragm and voice coil transducer for reducing or eliminating mechanical forces. Other aspects are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. The speakers incorporated within these devices may use a moving coil motor to drive sound output. The moving coil motor may include a diaphragm, voice coil and magnet assembly positioned within a frame. In some cases, however, the force output by the moving coil motor may be transmitted to the device enclosure, causing an undesirable rattling or shaking of the system.

SUMMARY

An aspect of the disclosure is directed to a transducer (e.g., a loudspeaker), which provides a force-balancing construction to eliminate, or greatly reduce, mechanical forces that may be transmitted into the system in which the transducer is installed or integrated, while maximizing the acoustic output. The term "mechanical force" is intended to refer to forces caused by the transducer when the transducer assembly vibrates or shakes and physically contacts the enclosure, or other system components. To accomplish this, the transducer may include a relatively symmetrical pair of opposing diaphragms, which in one aspect, move in opposite directions to provide an in-phase acoustic output. In addition, the transducer may include axially aligned voice coils attached to each diaphragm, and a magnet assembly positioned between the opposing diaphragms and voice coils. During operation, each diaphragm/voice coil assembly may move in opposite directions, which in turn creates opposing forces on the magnet assembly. By creating two opposing forces against the magnet assembly, any potential forces which could otherwise move the magnet assembly causing undesirable rattling, shaking, etc of the system, effectively cancel each other out, resulting in no net mechanical force transmission, or at least a greatly reduced mechanical force imparted into the system onto which the transducer is attached. In addition, both diaphragms and associated voice coils may be interconnected in that their vibration is driven by the same magnetic return path through the magnet assembly. Further, to rigidly connect the magnet assembly to the frame while still maintaining maximum inter-coil excursion clearance, a relatively stiff or rigid support member (or yoke) is provided. Representatively, a thin and relatively rigid sheet like support member may be positioned between the magnets and extend to the frame to connect the magnet assembly to the frame. In one aspect, the support member or yoke may be non-magnetic therefore used as a structural element, not a magnet return path, as is typically the case with yokes.

In addition, in still further aspects, the voice coil may be specially wound or reshaped to preserve the inter-coil clearance (or excursion space) between the coils. For example, one of more of the voice coils may be reshaped in the vicinity of the high rigidity connectors to preserve excursion space. Representatively, the voice coils may be deformed in the corners to reduce the z-height (or vertical dimension). For example, the voice coil wire may be wound vertically one layer on top of the other, and then deformed only in the corners to create a "J" shaped coil section with reduced z-height.

In still further aspects, the support member or yoke positioned between the magnets may be a vented central yoke. For example, the vented central yoke may include cut-outs around the outer perimeter which allow for improved thermal efficiency and acoustic transmission across the yoke, while still providing structural support as previously mentioned. In addition, the yoke in this aspect, may in some cases be thicker than the previously discussed yoke (in a speaker with tall form factor) and made of a ferromagnetic material to avoid losses due to the gap created between the magnets. Therefore, in this aspect, the support member or yoke may be used for magnetic purposes.

In other aspects, the transducer may include a nested coil configuration. For example, similar to the previously discussed configurations, the transducer may include a relatively symmetrical pair of opposing diaphragms and voice coils, and a magnet assembly in between. In this aspect, however, instead of aligning the voice coils axially, the voice coils may be nested within a magnet assembly having off-set magnetic gaps formed within a single magnet layer of the magnet assembly.

In still further aspects, the transducer assembly can be included in the device enclosure to create a haptic effect. For example, the transducer assembly may have a barometric-vent or b-vent that creates a tuned acoustic circuit for additional infrasonic system resonance.

More specifically, aspects of the disclosure include a transducer assembly including a frame and a dual diaphragm and voice coil assembly suspended from the frame. The dual diaphragm and voice coil assembly may include a first diaphragm and a first voice coil attached thereto and a second diaphragm and a second voice coil attached thereto. The first voice coil and the second voice coil may be between the first diaphragm and the second diaphragm, and the first diaphragm and the second diaphragm may be operable to move in opposite directions along an axis of vibration. The assembly may further include a magnet assembly positioned within the frame, and having a first magnet and a second magnet positioned between the first diaphragm and the second diaphragm, and a rigid support member to fixedly connect the magnet assembly to the frame. In some aspects, the support member may include a first side attached to the first magnet, a second side attached to the second magnet and a plurality of extension members that extend radially outward from the first magnet and the second magnet to fixedly connect the magnet assembly to the frame. In addition, the support member may have a z-height that is less than a z-height of the first magnet and the second magnet, and the support member may be made of a non-magnetic material. The magnet assembly may further include a ring shaped yoke, the ring shaped yoke encircles the first magnet and the second magnet to form a single magnetic return path for a magnetic field generated by the first magnet and the second magnet and drive a vibration of the first voice coil and the second voice coil. In some aspects, the first voice coil is inward to the second voice coil, and the magnet assembly may include a first gap and a second gap that are horizontally aligned with one another, and the first voice coil is vertically aligned with the first gap and the second voice coil is vertically aligned with the second gap. Still further, the first voice coil or the second voice coil may have a deformed corner having a shorter z-height than another portion of the first voice coil or the second voice coil. The support member may be a yoke made of a magnetic material and cut-outs within a portion of the yoke attached to the first magnet and the second magnet, and the cut-outs are dimensioned to allow for thermal or acoustic venting through the yoke. The support member may be positioned between the first magnet and the second magnet, and the support member may have a vent that vents an acoustic chamber coupled to the first diaphragm and an acoustic chamber coupled to the second diaphragm to an exterior environment. In some cases, the transducer assembly may be operable to provide a haptic output.

Another aspect of the disclosure may include a transducer assembly having a frame and a dual diaphragm and voice coil assembly suspended from the frame that are operable to move in opposite directions along an axis of vibration and reduce a mechanical force output to the frame. In addition, a magnet assembly may be positioned within the frame between the first diaphragm and the second diaphragm, the magnet assembly forming a single magnetic return path for a magnetic field used to drive a movement of both the first voice coil and the second voice coil along the axis of vibration. The magnet assembly may further include a support member attaching the magnet assembly to the frame, the support member having a number of extension members that extend from the magnet assembly to the frame. The magnet assembly may include a first magnet and a second magnet that are polarized in a same direction. In some cases, a first plate may be attached to the first magnet, a second plate may be attached to the second magnet, the first magnet and the second magnet are positioned on opposite sides of the support member, and the ring yoke may surround the first magnet and the second magnet. The extension members of the support member may extend through openings in the ring yoke to the frame. In some cases, at least one of the first voice coil and the second voice coil may have a deformed portion having a z-height that is less than a z-height of another portion of the first voice coil or the second voice coil.

In still further aspects, a transducer assembly is provided having a frame, a dual diaphragm and voice coil assembly suspended from the frame, and a magnet assembly positioned between the first diaphragm and the second diaphragm, the magnet assembly having a plurality of magnets that form a first gap horizontally aligned with a second gap, and the first voice coil is axially aligned with the first gap and the second voice coil is axially aligned with the second gap. In some cases, the plurality of magnets may include at least two magnets having opposite polarities. Each magnet may be horizontally aligned. In addition, the first voice coil may be a different size than the second voice coil.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect in this disclosure are not necessarily to the same aspect, and they mean at least one.

DETAILED DESCRIPTION

In this section we shall explain several preferred aspects of this invention with reference to the appended drawings. Whenever the shapes, relative positions and other aspects of the parts described in the aspects are not clearly defined, the scope of the invention is not limited only to the parts shown, which are meant merely for the purpose of illustration. Also, while numerous details are set forth, it is understood that some aspects of the invention may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
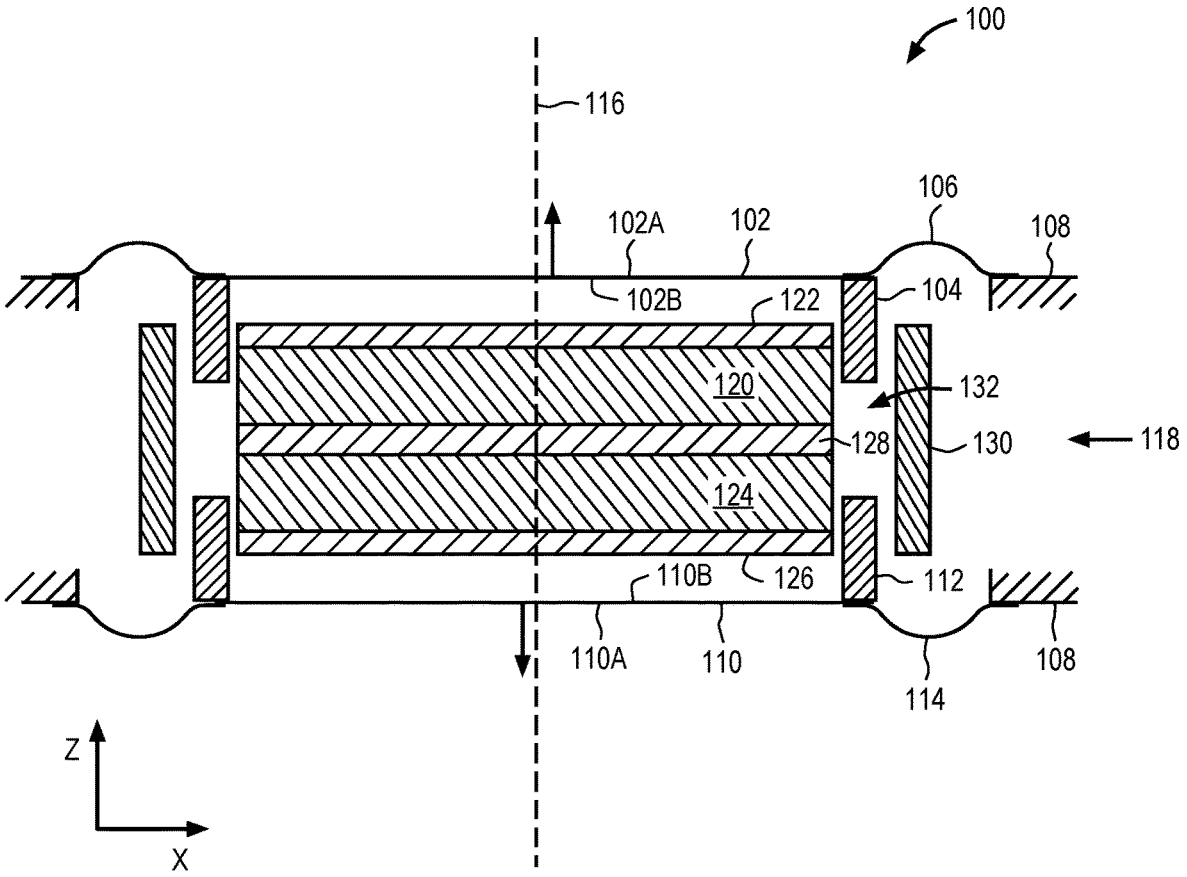
FIG. 1 illustrates a cross-sectional sided view of one aspect of a transducer assembly.

FIG. 1 illustrates a cross-sectional side view of an aspect of a transducer assembly. Transducer assembly 100 may be, for example, an electro-acoustic transducer that converts electrical signals into audible signals that can be output from a device within which transducer assembly 100 is integrated. For example, transducer assembly 100 may be a speaker integrated within a smart phone, or other similar compact electronic device such as a laptop, notebook, or tablet computer, or a loudspeaker. Transducer assembly 100 may be enclosed within a housing or enclosure of the device within which it is integrated.

Transducer assembly 100 may include a first diaphragm 102 and a first voice coil 104 attached to the first diaphragm 102. Diaphragm 102 may be any type of flexible membrane (which may include a number of material layers) capable of vibrating in response to an acoustic signal to produce acoustic or sound waves. Diaphragm 102 may include a first surface, face or side 102A and a second surface, face or side 102B. The first surface, face or side 102A may face one direction and the second surface, face or side 102B may face an opposite direction. The surface, face or side 102A may be considered a sound radiating surface, face or side (or top surface, face or side in this view) in that it generates a sound that is output by the transducer assembly 100. In this aspect, the surface, face or side 102A may be acoustically coupled to a front volume chamber and an acoustic output port of the transducer assembly 100 (e.g., see FIG. 5). The surface, face or side 102B, on the other hand, may be acoustically isolated from the first surface, face or side 102A, and considered an interior facing surface, face or side (or bottom side in this view) of diaphragm 102, which is acoustically coupled to a back volume chamber of transducer assembly 100. The first voice coil 104 may be attached to the second surface, face or side 102B of diaphragm, and the diaphragm 102 suspended from frame 108 by a suspension member 106. The suspension member 106 may be a compliant member (e.g., a membrane) which, in one aspect, is attached to side 102A of diaphragm 102 and allows for vibration of diaphragm 102 along the axis of vibration 116, as illustrated by the arrow. Although not shown, frame 108 may be a housing, or portion of a housing, which encloses all of the components of transducer assembly 100.

Transducer assembly 100 may further include a second diaphragm 110 and a second voice coil 112 attached to the second diaphragm 110. Second diaphragm 110 may be substantially similar to diaphragm 102 and include a first surface, face or side 110A facing one direction and a second surface, face or side 110B which faces an opposite direction. The surface, face or side 110A may be considered a sound radiating surface, face or side (or bottom surface, face or side in this view) in that it generates a sound that is output by the transducer assembly 100. For example, surface, face or side 110A may be acoustically coupled to a front volume chamber and an acoustic output port of the transducer assembly 100 (e.g., see FIG. 5). The surface, face or side 110B, on the other hand, may be considered an interior facing surface, face or side (or top side in this view) of diaphragm 110, which is acoustically isolated from side 110A and may be acoustically coupled to a back volume chamber of transducer assembly 100. Second voice coil 112 may be attached to the side 110E of diaphragm 110. The second diaphragm 110 and second voice coil 112 may be suspended from frame 108 by a suspension member 114. Similar to suspension member 106, suspension member 114 may be a compliant member (e.g., membrane) that is attached to, in one aspect, side 110A of diaphragm 110 and allows for vibration of diaphragm 110 along the axis of vibration 116, as illustrated by the arrow. In addition, it should be recognized that although first and second diaphragms 102, 110 are shown as planar structures, they may have one or more out-of-plane regions or sections, for example, they may have a convex, concave, or bowed region(s).

Transducer assembly 100 may further include a magnet assembly 118 positioned between first and second diaphragms 102, 110. Magnet assembly 118 may include a first magnet 120 having plate 122, a second magnet 124 having plate 126, and a yoke 130 surrounding the magnet/plate assemblies. The first and second magnets 120, 124 may be permanent magnets. The yoke 130 may be a ring shaped yoke dimensioned to surround magnets 120, 124 and form a gap 132 in between. The first and second magnets 120, 124 in combination with the plates 122, 126 and yoke 130 may form a magnetic circuit or magnetic return path for a magnetic field used to drive a movement of voice coils 104, 112 (and in turn diaphragms 102, 110), along the axis of vibration. The voice coils 104, 112 and diaphragms 102, 110 may move (e.g., vibrate) in opposite directions such that mechanical forces are cancelled, while still maintaining an in-phase acoustic output.

Figure 2:
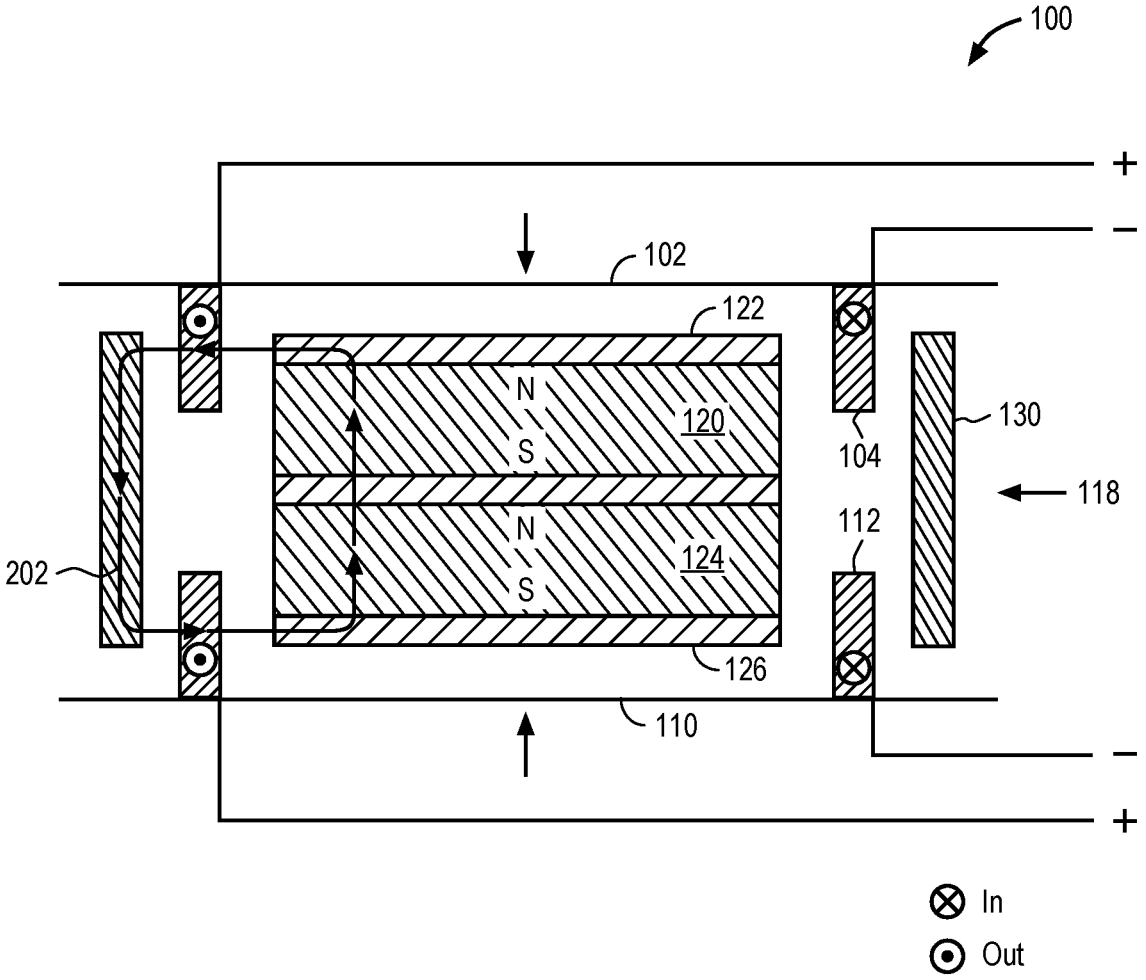
FIG. 2 illustrates a cross-sectional sided view of one aspect of a transducer assembly.

In addition, the vibration of both diaphragm and voice coil assemblies 102/104 and 110/112 may be driven by a same magnetic circuit, such that they may be considered interconnected or interlocked. A representative magnetic circuit used to drive both of voice coils 104, 112 is illustrated in FIG. 2. Representatively, similar to FIG. 1, FIG. 2 shows the first diaphragm 102 and first voice coil 104, and the second diaphragm 110 and voice coil 112, positioned in opposite directions such that the first and second voice coils 104, 112 are axially aligned with the gap 132. It can further be seen from this view that first voice coil 104 and second voice coil 112 are wound in a same direction (e.g., the coil wire is shown going into the page at the right side of the page, and out of the page at the left side of the page), and carry an input signal as shown. In addition, first magnet 120 and second magnet 124 may be polarized in a same direction. For example, both first magnet 120 and second magnet 124 may be polarized so that their north poles face the top (e.g., face first diaphragm 102) and their south poles face the bottom (e.g., face second diaphragm 110) of transducer assembly 100. The magnetic circuit or return path 202 is further shown running through the entire magnet assembly 118 in a counter clockwise direction. Representatively, the magnetic circuit or magnetic return path 202 goes through first magnet 120 and plate 122, to first voice coil 104, then to yoke 130, down yoke 130 to second voice coil 112, then through plate 126 and magnet 124. In this configuration, first diaphragm 102 and first voice coil 104, and the second diaphragm 110 and voice coil 112, are driven by a same magnetic circuit and may be caused to move in opposite directions along the axis of vibration, as shown by the arrows. As a result, any mechanical forces generated by the movement of first diaphragm 102 and first voice coil 104, and the second diaphragm 110 and voice coil 112, cancel one another out while still providing an in-phase acoustic output.

Returning again to FIG. 1, to suspend the magnet assembly 118 between the diaphragm/voice coil assemblies as shown, transducer assembly 100 may further include a yoke or support member 128. Support member 128 may be configured to attach magnet assembly 118 to frame 108. Representatively, in one aspect, support member 128 may be attached to interfacing sides of first magnet 120 and second magnet 124 and attached to frame 108. Support member 128 may attach magnet assembly 118 to the frame so that it remains relatively stationary within the assembly. In this aspect, support member 128 may be made of a rigid material that will not vibrate, bend or otherwise change its shape in response to vibrational forces caused by the diaphragm/voice coil assembly. In addition, support member 128 may be made relatively thin and of a non-magnetic material to maintain a reduced z-height and/or prevent interference with the previously discussed magnetic circuit or return path. For example, support member 128 may be made of titanium, aluminum or plastic. In this aspect, while support member 128 may be referred to as a yoke in some cases, it is not considered as forming part of the magnetic circuit or magnetic return path. To help maintain a reduced z-height, support member 128 may have a thickness or z-height (h) which is less than that of magnets 120, 124, and in some cases less than that of plates 122, 126.

Figure 3:
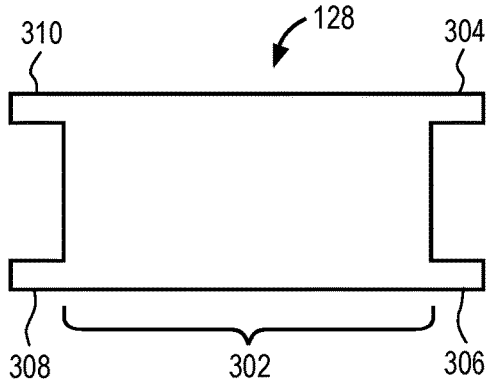
FIG. 3 illustrates a top plan view of a support member for a transducer assembly.

One exemplary configuration for support member 128 is illustrated in FIG. 3. Representatively, FIG. 3 is a top plan view of support member 128. From this view, it can be seen that support member 128 may have a generally elongated or rectangular shape, which includes a body portion 302 and extension portions or tabs 304, 306, 308, 310. The body portion 302 is attached to interfacing sides of the first and second magnets 120, 124, as previously discussed. Body portion 302 may have a similar shape, size, surface area, length and/or width to that of first and second magnets 120, 124. Tabs 304-310 may extend outwardly from body portion 302, and therefore extend beyond magnets 120, 124. Tabs 304-310 may extend from magnets 120, 124 to frame 108, when assembled, and can therefore be used to attach support member 128 (and the associated magnets 120, 124) to the frame 108. It should be understood that FIG. 1 illustrates a cross-sectional side view along a width dimension of assembly 100, therefore tabs 304-310 are not shown in FIG. 1.

Figure 4:
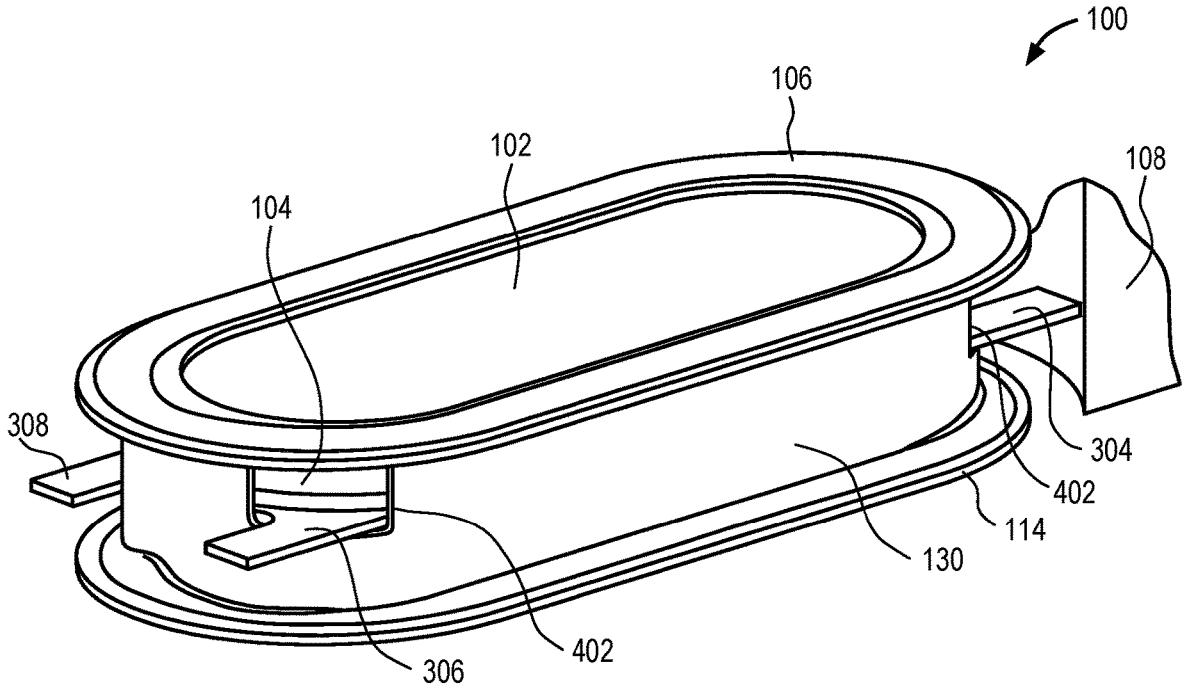
FIG. 4 illustrates a perspective side view of one aspect of a transducer assembly.
Figure 5:
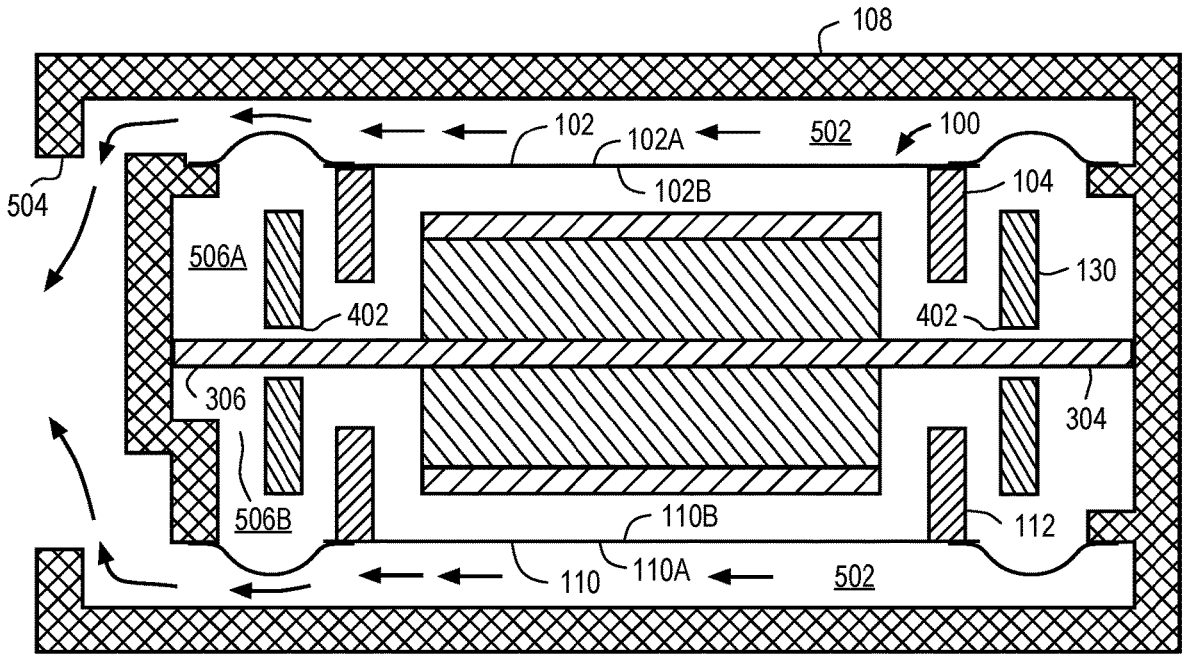
FIG. 5 illustrates a cross-sectional sided view of one aspect of a transducer assembly mounted within an enclosure.

The support member 128 including tabs 304-310 extending from the magnets 120, 124 to the frame 108 can be more clearly understood from FIGS. 4-5. Representatively, FIG. 4 is a perspective view of transducer assembly 100. As shown in FIG. 4, yoke 130 may be a ring shaped structure which almost entirely surrounds the magnets 120, 124. Tabs 304-310 extend from magnets 120, 124, through the excursion space between the voice coils 104, 112, and through openings 402 in yoke 130, to frame 108. To limit any interference with other aspects of the assembly, tabs 304-310 may extend from only certain portions of body portion 302. For example, tabs 304-310 may extend from the corners of body portion 302 in a lengthwise direction. In this embodiment, since tabs 304-310 extend from only the corners of body portion 302, only four openings in yoke 130 are necessary, and only the excursion space between the corners of voice coils 104, 112 is occupied by support member 128. It should be understood, however, that although four tabs 304-310 are shown, support member 128 may have any number of extension members or tabs, and at any locations around body portion 302, necessary to securely, and in a stationary manner, suspend the magnet assembly 118 from frame 108.

FIG. 5 shows a cross-sectional view of transducer assembly 100, taken along a length dimension of the assembly through tabs 304, 306 of support member 128 (e.g., the view is rotated 90 degrees from that of FIG. 1). From this view, it can be seen that when transducer assembly 100 is positioned within an interior chamber of frame 108, tabs 304 and 306 extend through the excursion space between voice coils 104, 112, and through openings 402 in yoke 130, to frame 108. Frame 108 may be an interior frame formed within an enclosure or housing of the device, or may be the device enclosure or housing itself. It can therefore be understood that since transducer assembly 100 is directly connected to frame 108, if it were to rattle, shake or otherwise move, these mechanical forces may be transmitted to frame 108, thus resulting in undesirable rattling, shaking, or movement of the frame 108. Since the dual diaphragm configuration of transducer assembly 100 cancels out these mechanical forces, undesirable rattling, shaking, or movement of the frame 108 is prevented or greatly reduced.

Still further, from this view, it can be seen that the sound output sides, faces or surfaces 102A, 110A of both diaphragms 102, 110 output sound to a front volume chamber 502, which is acoustically coupled to a sound output port 504 of the enclosure or frame 108. The sound output port 504 may be formed within any portion of the frame 108, for example a side (e.g., side ported device), a top (e.g., top ported device) or a bottom (e.g., bottom ported device). Transducer assembly 100 may provide an in-phase acoustic output from the frame within which it is integrated, as previously discussed. The opposing sides, faces or surfaces 102B, 110B of diaphragms 102, 110 are acoustically coupled to the back volume chamber, which is illustrated by volumes 506A, 506B that are acoustically coupled to one another, however, acoustically isolated from the front volume chamber 502. In FIG. 5, transducer assembly 100 is shown mounted near acoustic output port 504, however, it is contemplated that it may be mounted anywhere within frame 108 suitable for outputting a sound through acoustic output port 504.

Figure 6:
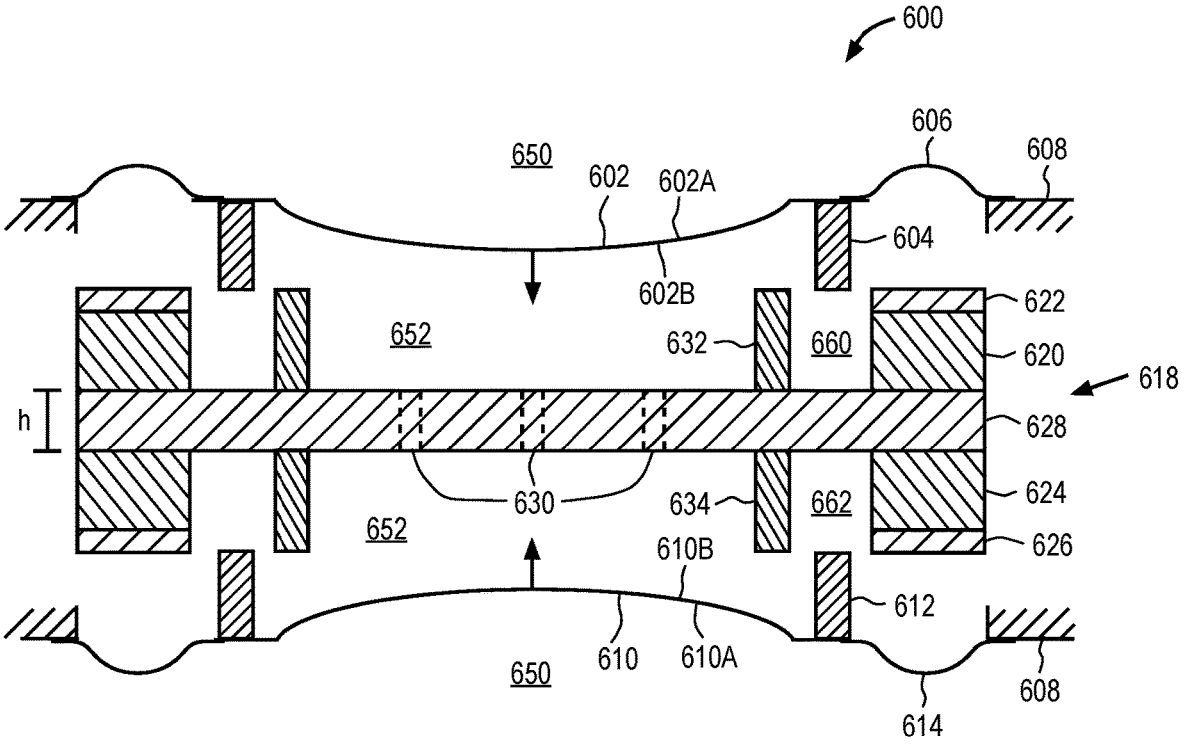
FIG. 6 illustrates a cross-sectional sided view of one aspect of a transducer assembly.

FIG. 6 illustrates a cross-sectional side view of another aspect of a transducer assembly. Similar to transducer assembly 100, transducer assembly 600 includes a first diaphragm 602 having a first voice coil 604 coupled thereto, and which are suspended from a frame 608 by a suspension member 606. Transducer assembly 600 may further include a second diaphragm 610 having a second voice coil 612 coupled thereto, and which are suspended from frame 608 by suspension member 614. In addition, similar to transducer assembly 100, the first voice coil 604 may be attached to an inwardly facing side, surface or face 602B of first diaphragm 602, and second voice coil 612 may be attached to an inwardly facing side, surface or face 610B of second diaphragm 610. In addition, first diaphragm 602 may include an outward or top face, surface or side 602A, and second diaphragm 610 may include an outward or bottom face, surface or side 610B. In this embodiment, however, outwardly facing sides, surfaces or faces 602A, 610A of diaphragms 602, 610 may be coupled to a back volume chamber 650 of the assembly, while the sides, surfaces or faces 602B, 610B that the voice coils 604, 612 are attached to may be acoustically coupled to a front volume chamber 652 (e.g. a volume extending along top and bottom sides of member 628 and coupled to an output port) of the assembly. Therefore, in this configuration, the sound output is from the sides, surfaces or faces 602B and 610B of the diaphragms 602, 610, toward the center of the assembly 600, as shown by the arrows. In addition, diaphragms 602, 610 may be non-planar in that they include a curved, bowed, or out of plane, sound radiating portion.

Figure 7:
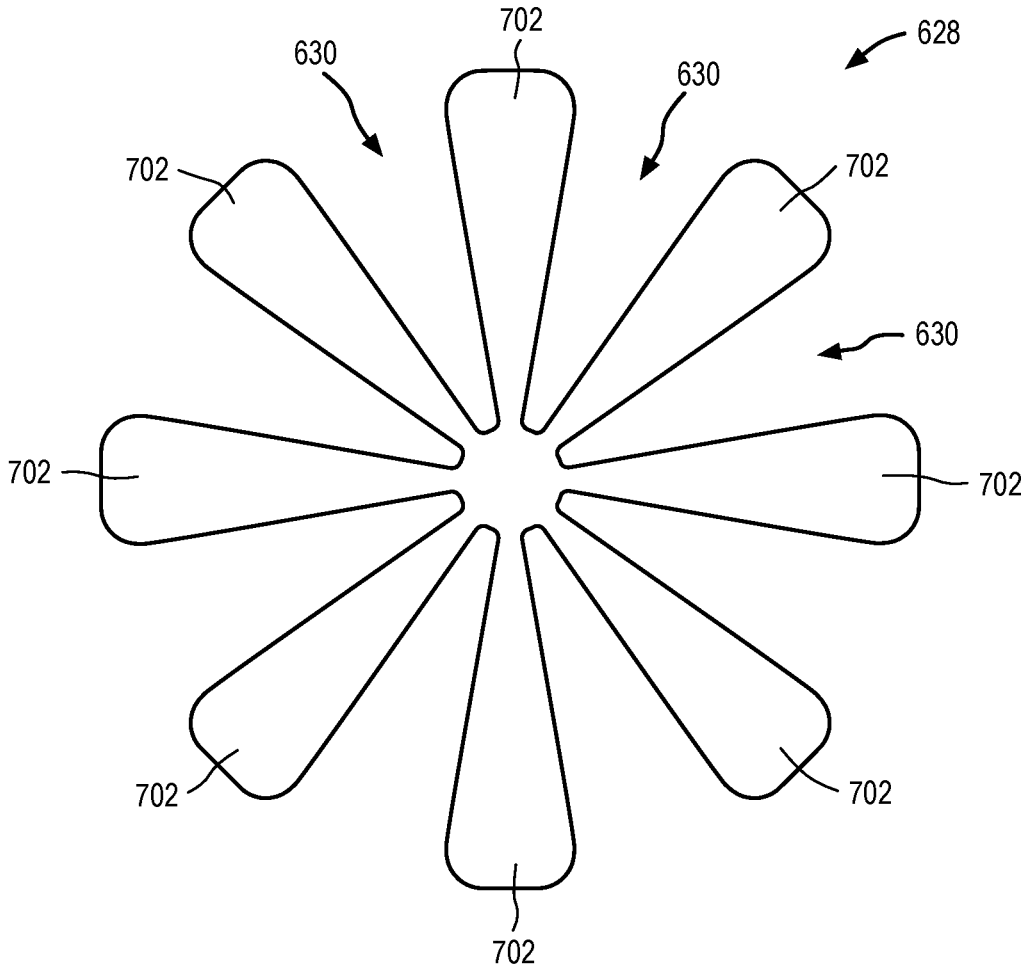
FIG. 7 illustrates a top plan view of a support member for a transducer assembly.

To facilitate transmission of the sound directed toward the center of the assembly 600 as illustrated by the arrows, transducer assembly 600 further includes a support member 628 for the magnet assembly 618, which includes vents to an exterior of assembly 600. Vented support member 628, similar to the support member of assembly 100, is attached to a magnet assembly 618 between the diaphragms 602, 610, and couples the magnet assembly to the frame 608. To allow for sound transmission through the center of assembly 600, support member 628 includes a number of openings, cutouts or vents 630. FIG. 7 illustrates a top plan view of vented support member 628. From this view, it can be seen that support member 628 may include lobes 702 which are connected at their center and spaced apart to form vents 630. Lobes 702, and the vents 630 formed between each of the lobes 702, extend outwardly from a center of the member to a perimeter of member 628 and have an elongated shape. In addition, support member 628 may have a substantially overall circular shape, although other shapes are contemplated. Moreover, in addition to venting of air and/or sound, vented support member 628 may provide a thermal path for transmission of heat generated within assembly to the outside, therefore improving thermal efficiency of assembly 600.

Returning now to FIG. 6, as previously discussed, in addition to venting, support member 628 is used to couple the magnet assembly 618 to frame 608. Similar to magnet assembly 118 of transducer assembly 100, magnet assembly 618 may include a first magnet 620 having a plate 622 attached to a side of the magnet facing first diaphragm 602 and a second magnet 624 having a plate 626 attached to a side of the magnet facing second diaphragm 610. The other side of first magnet 620 is attached to a top side of support member 628, and the other side of second magnet 624 is attached to a bottom side of support member 628. To accommodate venting, first and second magnets 620, 624 may be ring shaped magnets positioned concentrically outward to voice coils 604, 612, or have any other shape with an opening in the middle, such that they can be positioned around, or outward to, voice coils 604, 612. In other words, while they are still within the area between diaphragms 602, 610 similar to the previously configurations, they are not directly above/below or vertically aligned with the diaphragms 602, 610, rather they are aligned with suspension members 606, 614.

In addition, magnet assembly 618 may further include a first yoke 632 and a second yoke 634. The first yoke 632 may be a ring shaped structure positioned on a same side of support member 628 as first magnet 620, and concentrically inward to first voice coil 604. A gap 660 for accommodating the excursion of first voice coil 604 is therefore formed between first magnet 620 and plate 622 and first yoke 632. The second yoke 634 may be a ring shaped structure positioned on a same side of support member 628 as second magnet 624, and concentrically inward to voice coil 612. A gap 662 for accommodating the excursion of second voice coil 612 is therefore formed between second magnet 624 and plate 626 and second yoke 634. Although yokes 632 and 634 are described as ring shaped structures, they may have any shape so long as they have an opening through the center that allows for passage of air (or sound or heat) through support member 628. In addition, although yokes 632 and 634 are described as separate structures which are attached to opposing sides of support member 628, it is contemplated that support member 628 and yokes 632, 634 may be one integrally formed structure.

As previously discussed, support member 628 may be a relatively rigid structure used for venting and to attach the magnet assembly 618 to the frame 608, in a relatively stationary configuration. In addition, in some aspects, when a relatively low z-height of assembly 600 is not required, support member 628 may be relatively thick, or have a larger or greater z-height (h), than the previously discussed support member. For example, support member 628 may have a thickness or z-height (h) greater than one or more of plates 622, 626. In addition, in aspects where support member 628 is relatively thick or has an increased z-height, support member 628 may be made of a ferromagnetic material to avoid magnetic flux losses due to the relatively large gap it creates between first and second magnets 620, 624. Support member 628 may therefore also be referred to as a yoke, and considered part of the magnet assembly 618.

Although not shown, the first and second magnets 620, 624 in combination with the plates 622, 626 and yokes 632, 634 (and in some cases support member 628) may form a magnetic circuit or magnetic return path for a magnetic field used to drive a movement of voice coils 604, 612, along the axis of vibration, in such a way that mechanical forces are cancelled as previously discussed. It is further contemplated that in this configuration in which the support member 628 may be made of a ferromagnetic material, the first and second magnets 620, 624 may be positioned in opposite directions instead of the same direction. It is contemplated that facing the magnetic poles in opposite directions helps to reduce a magnetic flux loss going through support member 628.

Figure 8:
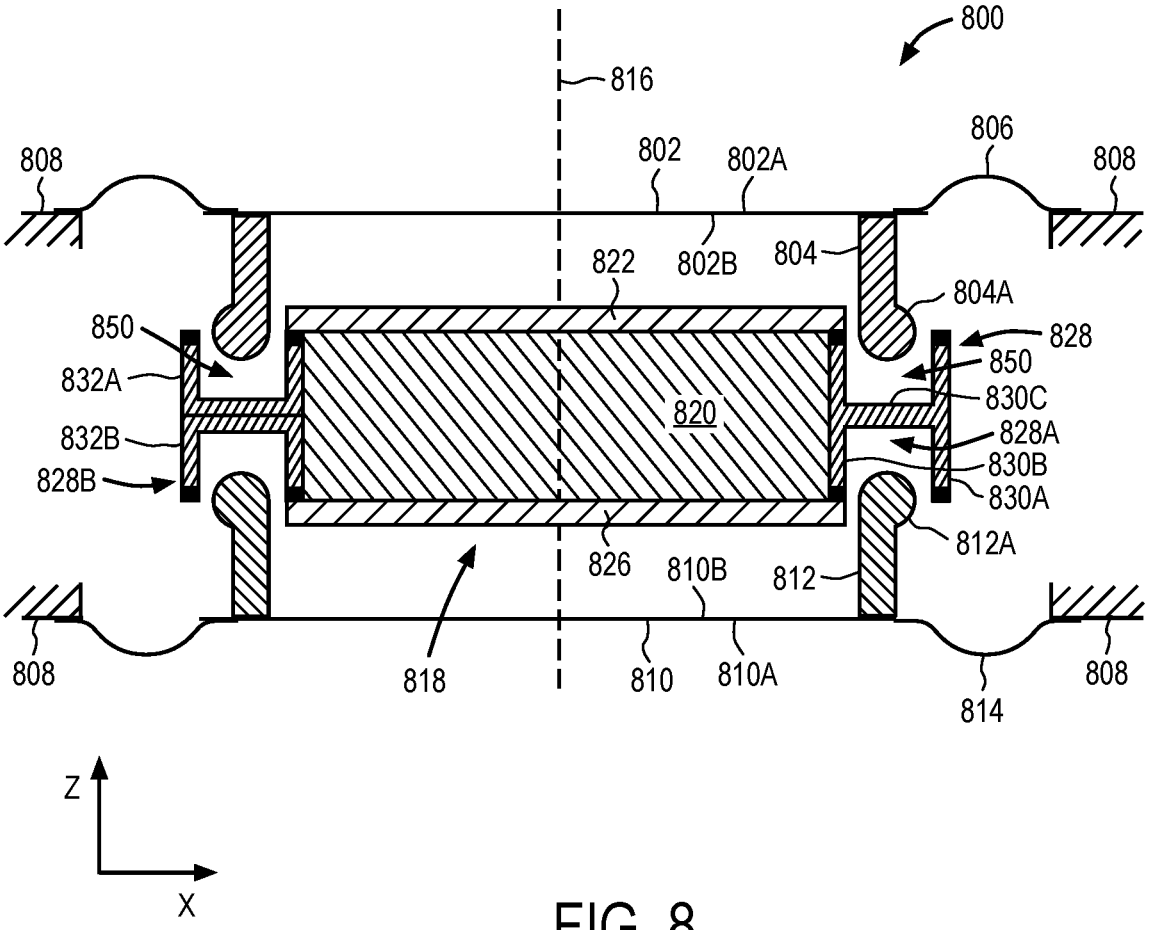
FIG. 8 illustrates a cross-sectional sided view of one aspect of a transducer assembly.

FIG. 8 illustrates a cross-sectional side view of another aspect of a transducer assembly. Similar to the previously discussed assemblies, transducer assembly 800 include a first diaphragm 802 having a first voice coil 804 coupled thereto, and which are suspended from a frame 808 by a suspension member 806. Transducer assembly 800 may further include a second diaphragm 810 having a second voice coil 812 coupled thereto, and which are suspended from frame 808 by suspension member 814. In addition, similar to the previously discussed configurations, the first voice coil 804 may be attached to an inwardly facing side, surface or face 802B of first diaphragm 802, and second voice coil 812 may be attached to an inwardly facing side, surface or face 810B of second diaphragm 810. The first voice coil 804 and second voice coil 812 are axially, or vertically, aligned with one another along the axis of vibration 816, such that they occupy a same excursion space or gap 850 formed around magnet assembly 818. In addition, first diaphragm 802 may include an outward or top face, surface or side 802A, and second diaphragm 810 may include an outward or bottom face, surface or side 810A. In some embodiments, the outward or top face, surface of side 802A and outward or bottom face, surface or side 810A of diaphragms 802 and 810, respectively, may generate a sound output and be acoustically coupled to a front volume chamber and sound output port of the assembly. The inwardly facing side, surface or face 802B of first diaphragm 802, and inwardly facing side, surface or face 810B of second diaphragm 810 may be acoustically coupled to a back volume chamber, which is acoustically isolated from the front volume chamber.

Transducer assembly 800 may further include a magnet assembly 818 positioned between first and second diaphragms 802, 810 and coupled to the frame 808 by a support member 828. The magnet assembly 818 may include a magnet 820 having a top plate 822, attached to a side facing first diaphragm 802, and a bottom plate 826, attached to a side facing second diaphragm 810. Magnet 820 may be a single permanent magnet as shown. In other aspects, magnet 820 may be two or more magnets similar to the previously discussed magnet assemblies.

Transducer assembly 800 may further include a support member 828 to attach the magnet assembly 818 to frame 808. Support member 828 may be attached to one or more sides of magnet 820, and attach magnet assembly 818 to the frame, according to a number of different configurations. Similar to the previously discussed support members, support member 828, and the various configurations disclosed herein, are substantially rigid members which secure magnet assembly 818 to the frame 808 using high rigidity connections.

Representatively, in one aspect, a support member 828A is shown as an I or H-shaped structure having vertical flanges 830A, 830B, connected together by a horizontal member 830C. Flange 830B may be attached to the side of the magnet 820 and flange 830B may be attached to the frame (not shown). The excursion space or gap 850 for voice coils 804, 812 are formed along opposite sides of horizontal member 830C, between flanges 830A, 830B. In another aspect, a support member 828A is shown as an I or H-shaped structure formed by two C-brackets 832A, 832B, facing different directions. In this aspect, the top C-bracket 832A forms the excursion space or gap 850 for first voice coil 804 and the bottom C-bracket 832B forms the excursion space or gap for second voice coil 812. The magnet 820 in combination with the plates 822, 826 and support member 828 (e.g., support member 828A or 828B) may form a magnetic circuit or magnetic return path for a magnetic field that passes through gap 850 and is used to drive a movement of voice coils 804, 812 (and diaphragms 802A, 810A), along the axis of vibration.

As can be seen from FIG. 8, the size of the excursion space or gap 850 for voice coils 804, 812 is limited by the horizontal portion of the support member 828. As previously discussed, diaphragms 802, 810 and the associated voice coils 804, 812 may move in opposite directions, therefore it is critical that a clearance between voice coils 804, 812 be maintained to ensure maximum excursion. In this aspect, portions of voice coils 804, 812 that are vertically or axially aligned with gaps 850 formed by support member 828 may have a reduced z-height so that under-coil clearance is preserved. Representatively, in one aspect, the z-height is reduced by deforming the bottom portions 804A, 812A, of the voice coils 804 and 812, respectively. For example, the bottom portions 804A, 812A may be bent outwardly or inwardly so that the overall z-height is reduced, and the under-coil clearance between the bottom portions 804A, 812A and the horizontal members of support member 828 is increased.

Figure 9:
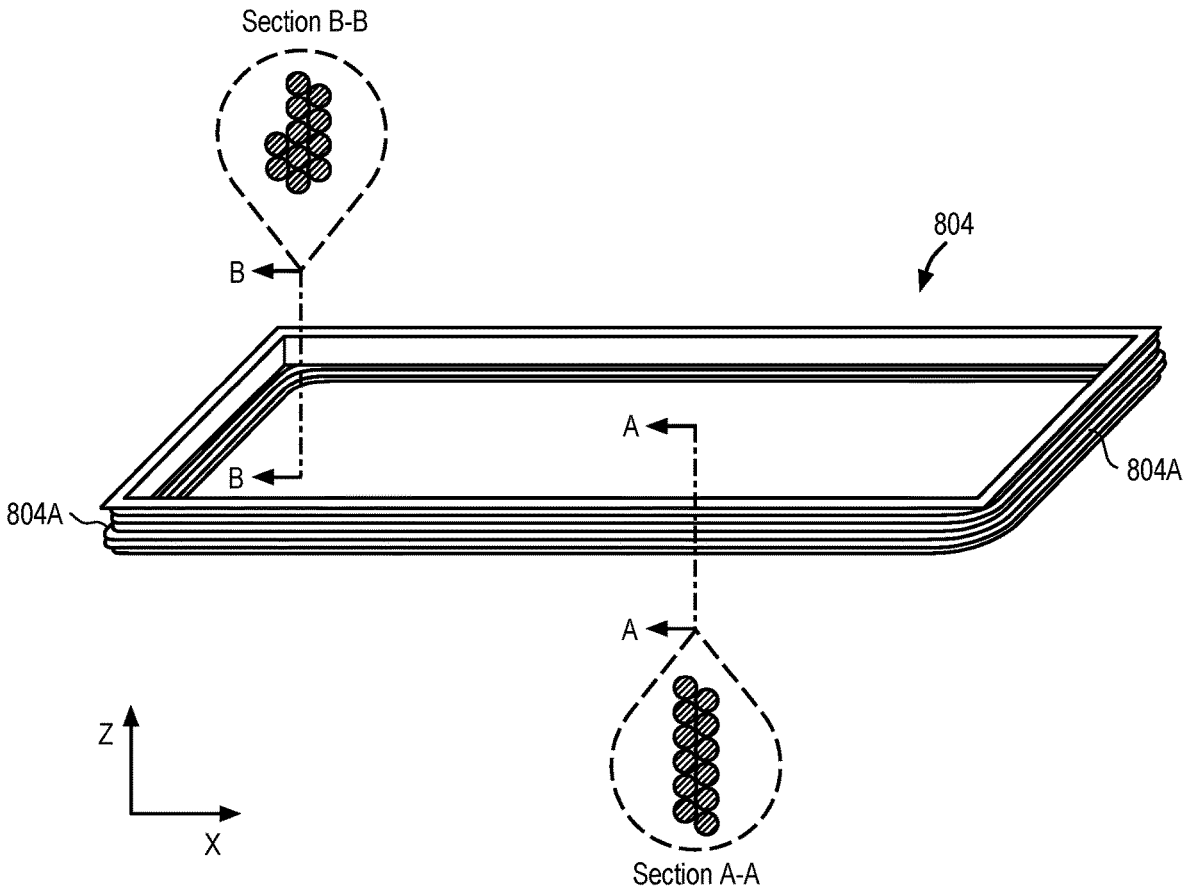
FIG. 9 illustrates a perspective view of a voice coil for a transducer assembly.

FIG. 9 illustrates a magnified perspective view of voice coil 804 having deformed portions. Representatively, as can be seen from FIG. 9, in one aspect, voice coil 804 includes deformed ends 804A at only the corners of the voice coil 804. For example, in some aspects, support member 828 extends between the voice coils 804, 812 at only the corners. Therefore, an under-coil clearance at only the corners of voice coils 804, 812 is reduced by support member 828. In this aspect, only the corner portions of voice coil 804 are deformed. The reduction in z-height of the corners in comparison to the rest of the voice coil 804 can be more clearly seen from the exploded views along the length dimension section line A-A and the corner dimension section line B-B. In particular, from these views, it can be seen that the corners of voice coil 804 have deformed ends 804A, which reduce the overall z-height in those regions. It should be understood that while the deformations are illustrated at only corners of voice coil 804, they may be formed at any portion of voice coil 804 where under-coil clearance is an issue. Voice coils 804, 812 may be deformed during the manufacturing process. For example, when the voice coil wire is being wound one layer on top of another (either in a rectangular or round configuration) and is still hot, the end portions where deformation is desired may be bent or crushed as shown. The coil wire may then be cooled setting the final voice coil shape with permanently deformed corners. The deformation, being applied during the winding process, can be achieved with minimal additional cycle time or cost. Beneficially, the portion of the coil which is deformed may be minimized in comparison to the total circumference of the coil in order to have minimal impact on the coil/magnetic gap topology in the remaining portions of the coil.

In addition, it is further contemplated that although support member 828 is shown having flanges, support member 828 may be a substantially planar structure, similar to support member 128, and include substantially planar extension members or tabs, as previously discussed. In other words, a voice coil having deformed portions may be used in any of the previously discussed configurations.

Figure 10:
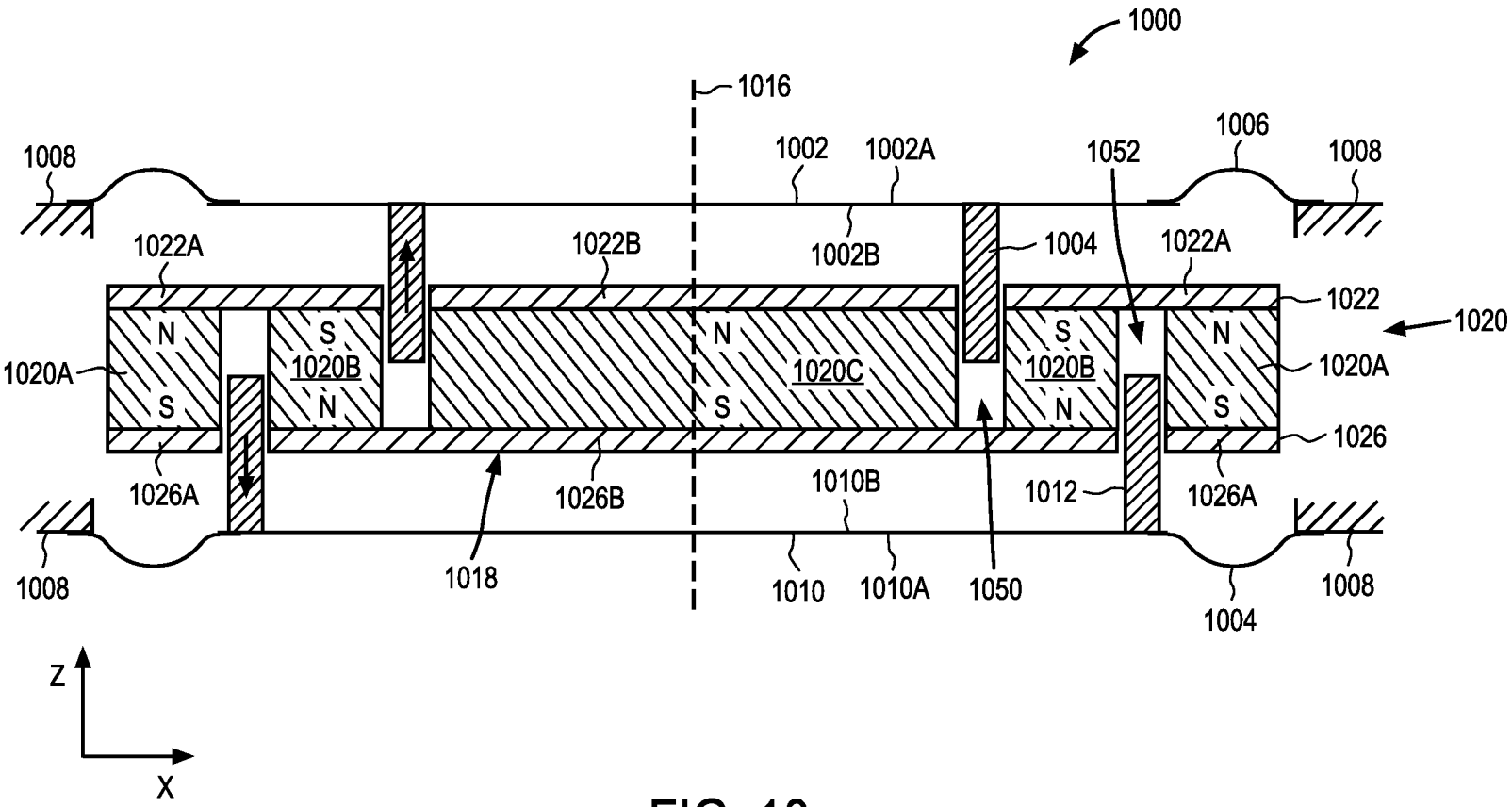
FIG. 10 illustrates a cross-sectional sided view of one aspect of a transducer assembly.

FIG. 10 illustrates a cross-sectional side view of another aspect of a transducer assembly. Transducer assembly 1000 may be similar to the previously discussed assemblies in that it includes a first diaphragm 1002 having a first voice coil 1004 coupled thereto, and which are suspended from a frame 1008 by a suspension member 1006. Transducer assembly 1000 may further include a second diaphragm 1010 having a second voice coil 1012 coupled thereto, and which are suspended from frame 1008 by suspension member 1014. In addition, similar to the previously discussed configurations, the first voice coil 1004 may be attached to an inwardly facing side, surface or face 1010B of first diaphragm 1002, and second voice coil 1012 may be attached to an inwardly facing side, surface or face 1010E of second diaphragm 1010. In addition, first diaphragm 1002 may include an outward or top face, surface or side 1002A, and second diaphragm 1010 may include an outward or bottom face, surface or side 1010A. In some embodiments, the outward or top face, surface of side 1002A and outward or bottom face, surface or side 1010A of diaphragms 1002 and 1010, respectively, may generate a sound output and be acoustically coupled to a front volume chamber and sound output port of the assembly. The inwardly facing side, surface or face 1002B of first diaphragm 1002, and inwardly facing side, surface or face 1010E of second diaphragm 1010 may be acoustically coupled to a back volume chamber, which is acoustically isolated from the front volume chamber.

In this aspect, however, the magnet assembly 1018 positioned between diaphragms 1002, 1010 forms magnetic or air gaps 1050, 1052 which are horizontally aligned, as opposed to vertically, and voice coils 1004, 1012 are aligned with each of the gaps 1050, 1052, respectively, in a nested configuration. In this aspect, transducer assembly 1000 has a substantially reduced z-height. For example, magnet assembly 1018 may include a center magnet assembly 1020 having a top plate assembly 1022 attached to the top side and a bottom plate assembly 1026 attached to the bottom side. The center magnet assembly 1020 includes a number of permanent magnets 1020A, 1020B, and 1020C which are horizontally aligned and spaced apart to form horizontally aligned gaps 1050 and 1052 in between. Gap 150 may be considered an inner gap, inward to, or closer to a center of the assembly, than gap 152. Gap 152 may be considered an outer gap, outward to, or farther from a center of assembly, than gap 152. The top plate assembly 1022 includes a number of plates 1022A and 1022B which are attached to the sides of magnets 1020A-1020C facing diaphragm 1002 to form portions of the sides or bottoms of gaps 1050 and 1052, as shown. The bottom plate assembly 1026 includes a number of plates 1026A and 1026B which are attached to the sides of magnets 1020A-1020C facing diaphragm 1010 to form portions of the sides or bottoms of gaps 1050 and 1052, as shown. The permanent magnets 1020A-1020C in combination with plates 1022A-1022B and plates 1026A-1026B form magnetic circuits or magnetic return paths for a magnetic field across each of gaps 1050, 1052 that can be used to drive a movement of voice coils 1004, 1012, along the axis of vibration 1016, as shown by the arrows. In this aspect, magnets 1020A-1020C on each side of a respective one of gaps 1050, 1052 may be polarized in opposite directions. For example, magnets 1020A and 120B forming gap 1052 may have opposite polarities, and magnets 120B and 120C forming gap 1050 may have opposite polarities. Representatively, in one aspect, magnets 1020A and 1020C may have north and south poles facing in a same direction, while magnet 1020B has north and south poles facing in directions opposite that of magnets 1020A and 1020C. For example, magnets 1020A and 1020C may have north poles facing diaphragm 1002 and south poles facing diaphragm 1010, while magnet 1020C has a north pole facing diaphragm 1010 and a south pole facing diaphragm 1002. In addition, although now shown, transducer assembly 1000 may have a support member for rigidly attaching the magnet assembly 1018 to the frame 1008, as previously discussed.

Voice coils 1004, 1012 may be aligned with each of gaps 1050, 1052. For example, voice coils 1004, 1012 may have different sizes so that first voice coil 1004 aligns with gap 1050 and second voice coil 1012 aligns with gap 152. Representatively, first voice coil 1004 may be narrower, or have a shorter dimension along the x-axis, than second voice coil 1012 such that first voice coil 1004 is inward to second voice coil 1012 and aligned with gap 1050. Said another way, voice coil 1012 may be considered to surround, or be outward to voice coil 1004. Voice coils 1004, 1012, and in turn their associated diaphragms 1002, 1010 may be driven in opposite directions as illustrated by the arrows.

Figure 11:
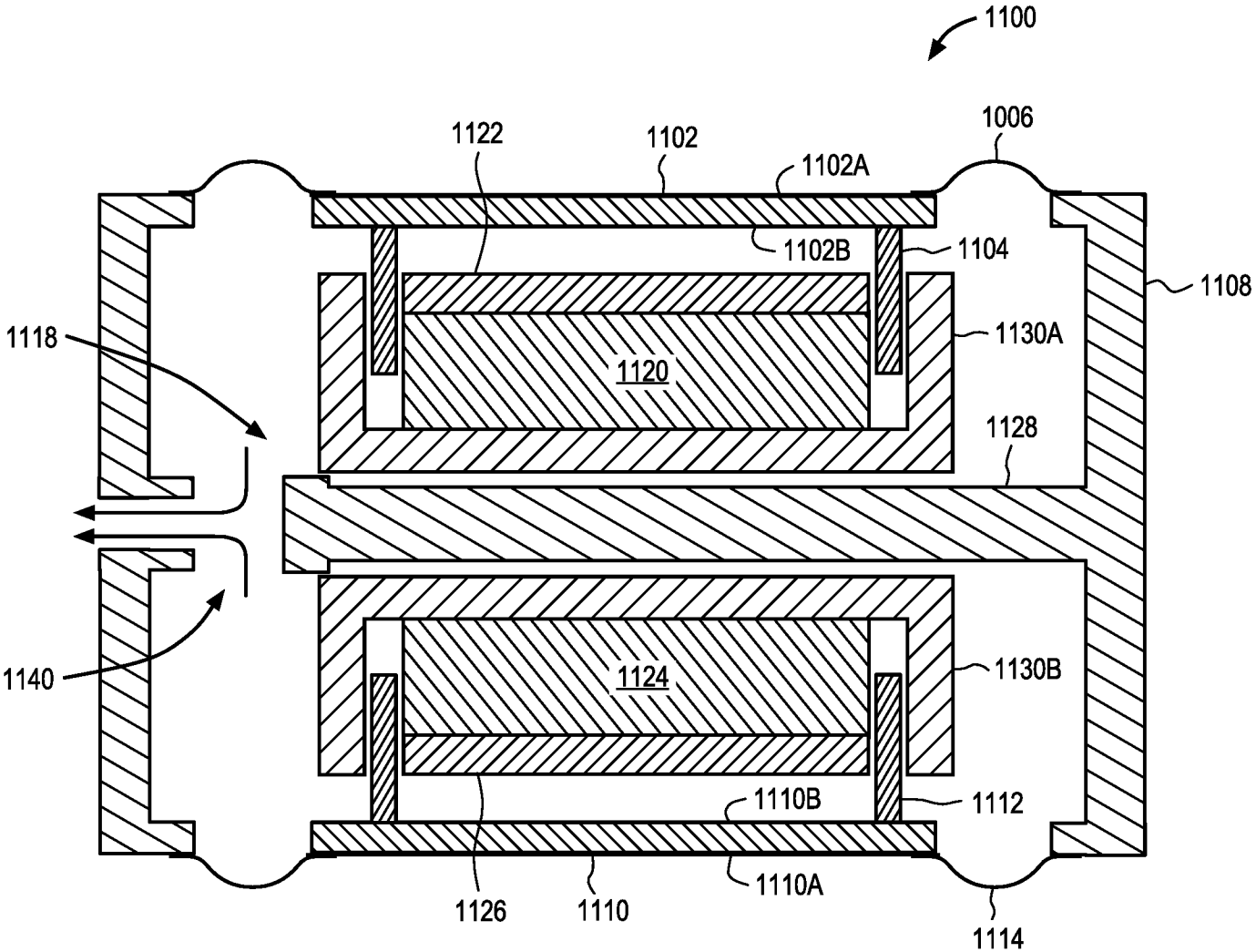
FIG. 11 illustrates a cross-sectional sided view of one aspect of a transducer assembly.

FIG. 11 illustrates a cross-sectional side view of another aspect of a transducer assembly. Transducer assembly 1100 is similar to the previously discussed configurations, except assembly 1100 includes a shared vent 1140 (e.g., barometric vent or b-vent) that creates a tuned circuit for force cancellation and/or a haptic effect. Representatively, transducer assembly 1100 includes a first diaphragm 1102 having a first voice coil 1104 coupled thereto, and which are suspended from a frame 1108 by a suspension member 1106. Transducer assembly 1100 may further include a second diaphragm 1110 having a second voice coil 1112 coupled thereto, and which are suspended from frame 1108 by suspension member 1114. In addition, similar to the previously discussed configurations, the first voice coil 1104 may be attached to an inwardly facing side, surface or face 1102B of first diaphragm 1102, and second voice coil 1112 may be attached to an inwardly facing side, surface or face 1110E of second diaphragm 1110. In addition, first diaphragm 1102 may include an outward or top face, surface or side 1102A, and second diaphragm 1110 may include an outward or bottom face, surface or side 1110A. One of surfaces 1102A, 1102B of diaphragm 1102 may be acoustically coupled to a front volume chamber and one may be coupled to a back volume chamber. In addition, one of surfaces 1112A, 1112B may be acoustically coupled to a front volume chamber and one may be coupled to a back volume chamber.

Magnet assembly 1118 may be positioned between diaphragms 1102, 1110, and coupled to frame 1108 by a support member 1128. Magnet assembly 1118 may include a first magnet 1120 having a first plate 1122 which are surrounded by a yoke 1130A to form a gap for first voice coil 1104. Magnet assembly 1118 may further include a second magnet 1124 having a second plate 1126 which are surrounded by a yoke 1130B to form a gap for second voice coil 1110.

A support member 1128 may be positioned between magnets 1120, 1124, for example attached to interfacing sides of yokes 1130A, 1130B, and extend outward from the magnets to attach magnet assembly 1118 to frame 1108. Support member 1128 may be similar to the previously discussed support members (e.g., a rigid structure) except in this configuration, support member 1128 further includes a shared vent 1140 (e.g., barometric vent or b-vent) between the acoustic volumes (e.g., back volumes) on opposite sides of support member 1128. Representatively, as shown in FIG. 11, vent 1140 connects the acoustic volumes on each side of support member 1128 to an exterior environment. In this aspect, vent 1140 may be used to create a tuned circuit for additional infrasonic system resonance. For example, in some aspects, the assembly 1100 may be configured to drive movement of the voice coils 1104, 1112, and associated diaphragms 1102, 1110 in a same direction, to produce a force output into the system that can be used to create a haptic effect. Alternatively, diaphragms 1102, 1110 may be driven in opposite directions as previously discussed for force cancellation.

Figure 12:
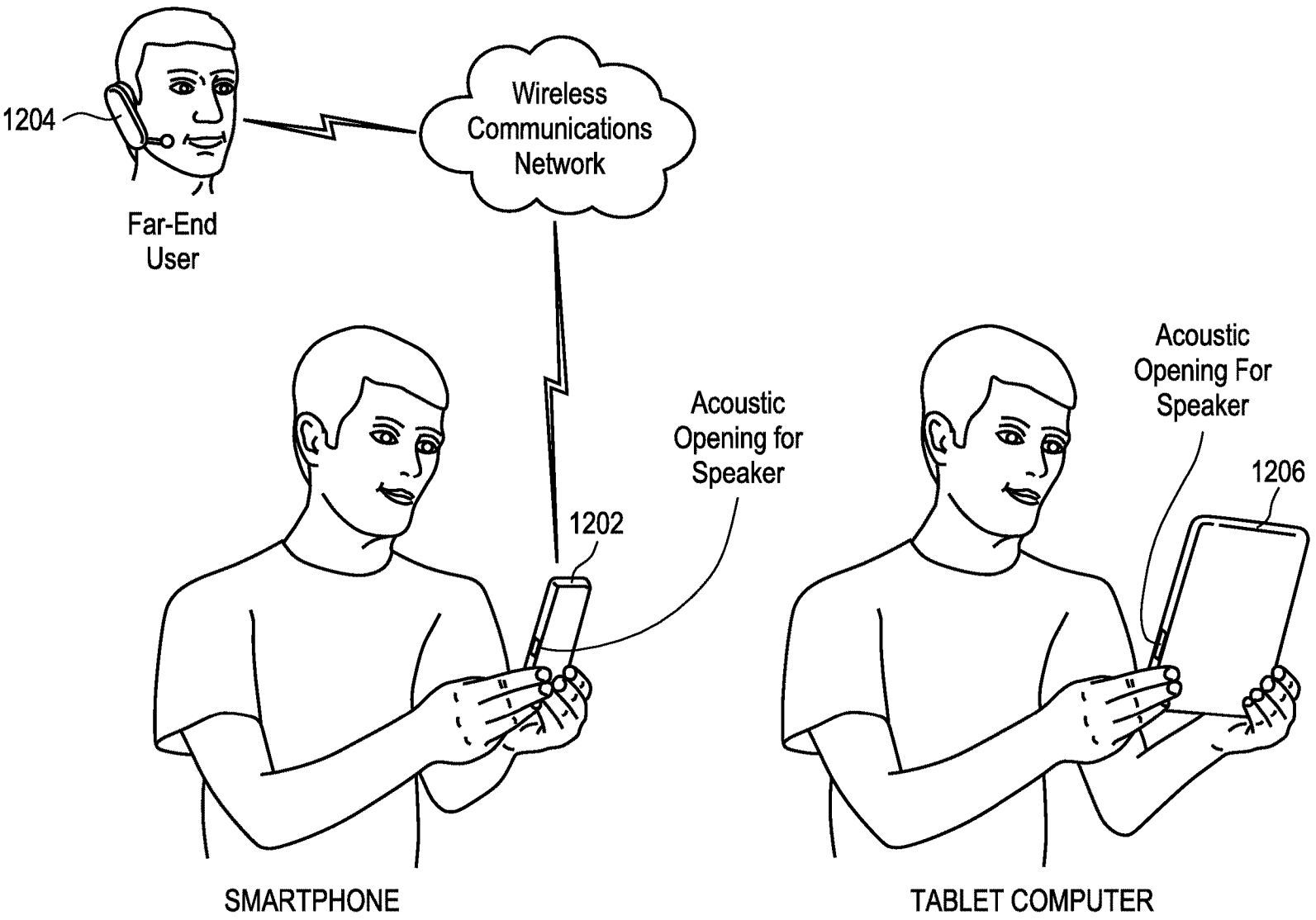
FIG. 12 illustrates a simplified schematic view of an electronic device in which a transducer assembly may be implemented.

FIG. 12 illustrates a simplified schematic perspective view of an exemplary electronic device in which a transducer assembly as described herein, may be implemented. As illustrated in FIG. 12, the transducer assembly may be integrated within a consumer electronic device 1202 such as a smart phone with which a user can conduct a call with a far-end user of a communications device 1204 over a wireless communications network; in another example, the transducer assembly may be integrated within the housing of a tablet computer 1206. These are just two examples of where the transducer assembly described herein may be used; it is contemplated, however, that the transducer assembly may be used with any type of electronic device, for example, a home audio system, any consumer electronics device with audio capability, or an audio system in a vehicle (e.g., an automobile infotainment system.).

Figure 13:
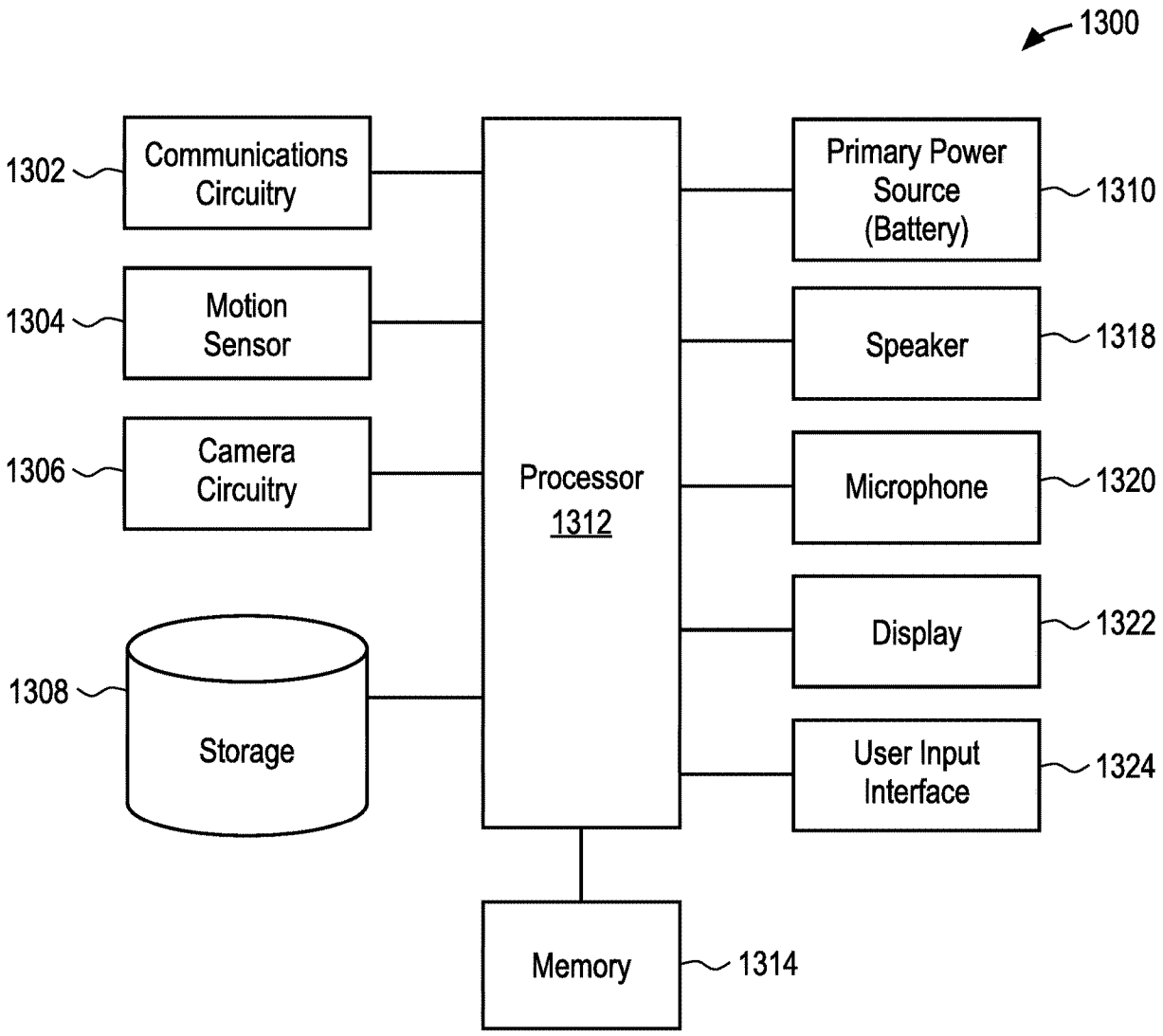
FIG. 13 illustrates a block diagram of some of the constituent components of an electronic device in which a transducer assembly may be implemented.

FIG. 13 illustrates a block diagram of some of the constituent components of an electronic device in which the transducer assembly disclosed herein may be implemented. Device 1300 may be any one of several different types of consumer electronic devices, for example, any of those discussed in reference to FIG. 13.

In this aspect, electronic device 1300 includes a processor 1312 that interacts with camera circuitry 1306, motion sensor 1304, storage 1308, memory 1314, display 1322, and user input interface 1324. Main processor 1312 may also interact with communications circuitry 1302, primary power source 1310, speaker 1318 and microphone 1320. Speaker 1318 may be the transducer assembly described herein, for example, a micro speaker assembly. The various components of the electronic device 1300 may be digitally interconnected and used or managed by a software stack being executed by the processor 1312. Many of the components shown or described here may be implemented as one or more dedicated hardware units and/or a programmed processor (software being executed by a processor, e.g., the processor 1312).

The processor 1312 controls the overall operation of the device 1300 by performing some or all of the operations of one or more applications or operating system programs implemented on the device 1300, by executing instructions for it (software code and data) that may be found in the storage 1308. The processor 1312 may, for example, drive the display 1322 and receive user inputs through the user input interface 1324 (which may be integrated with the display 1322 as part of a single, touch sensitive display panel). In addition, processor 1312 may send an audio signal to speaker 1318 to facilitate operation of speaker 1318.

Storage 1308 provides a relatively large amount of "permanent" data storage, using nonvolatile solid state memory (e.g., flash storage) and/or a kinetic nonvolatile storage device (e.g., rotating magnetic disk drive). Storage 1308 may include both local storage and storage space on a remote server. Storage 1308 may store data as well as software components that control and manage, at a higher level, the different functions of the device 1300.

In addition to storage 1308, there may be memory 1314, also referred to as main memory or program memory, which provides relatively fast access to stored code and data that is being executed by the processor 1312. Memory 1314 may include solid state random access memory (RAM), e.g., static RAM or dynamic RAM. There may be one or more processors, e.g., processor 1312, that run or execute various software programs, modules, or sets of instructions (e.g., applications) that, while stored permanently in the storage 1308, have been transferred to the memory 1314 for execution, to perform the various functions described above.

The device 1300 may include communications circuitry 1302. Communications circuitry 1302 may include components used for wired or wireless communications, such as two-way conversations and data transfers. For example, communications circuitry 1302 may include RF communications circuitry that is coupled to an antenna, so that the user of the device 1300 can place or receive a call through a wireless communications network. The RF communications circuitry may include a RF transceiver and a cellular baseband processor to enable the call through a cellular network. For example, communications circuitry 1302 may include Wi-Fi communications circuitry so that the user of the device 1300 may place or initiate a call using voice over Internet Protocol (VOIP) connection, transfer data through a wireless local area network.

The device may include a speaker 1318. Speaker 1318 may be a transducer assembly such as that described in reference to FIGS. 1-11. Speaker 1318 may be an electric-to-acoustic transducer or sensor that converts an electrical signal input (e.g., an aocustic input) into sound. The circuitry of the speaker may be electrically connected to processor 1312 and power source 1310 to facilitate the speaker operations as previously discussed (e.g, diaphragm displacement, etc).

The device 1300 may further include a motion sensor 1304, also referred to as an inertial sensor, that may be used to detect movement of the device 1300, camera circuitry 1306 that implements the digital camera functionality of the device 1300, and primary power source 1310, such as a built in battery, as a primary power supply.

While certain aspects have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A transducer assembly comprising:

a frame;

a dual diaphragm and voice coil assembly suspended from the frame, the dual diaphragm and voice coil assembly having a first diaphragm and a first voice coil attached thereto and a second diaphragm and a second voice coil attached thereto, wherein the first voice coil and the second voice coil are between the first diaphragm and the second diaphragm, and the first diaphragm and the second diaphragm are operable to move in opposite directions along an axis of vibration;

a magnet assembly positioned within the frame, the magnet assembly having a first magnet and a second magnet positioned between the first diaphragm and the second diaphragm; and a rigid support member to fixedly connect the magnet assembly to the frame, and a z-height of the entire support member is less than a z-height of the first magnet or the second magnet.

2. The transducer assembly of claim 1 wherein the support member comprises a first side attached to the first magnet, a second side attached to the second magnet and a plurality of extension members that extend radially outward from the first magnet and the second magnet to fixedly connect the magnet assembly to the frame.

3. The transducer assembly of claim 1 wherein the support member is a planar sheet of a non-magnetic material.

4. The transducer assembly of claim 1 wherein the magnet assembly further comprises a ring shaped yoke, the ring shaped yoke encircles the first magnet and the second magnet to form a single magnetic return path for a magnetic field generated by the first magnet and the second magnet and drive a vibration of the first voice coil and the second voice coil.

5. The transducer assembly of claim 1 wherein the first voice coil is inward to the second voice coil, and the magnet assembly comprises a first gap and a second gap that are horizontally aligned with one another, and the first voice coil is vertically aligned with the first gap and the second voice coil is vertically aligned with the second gap.

6. The transducer assembly of claim 1 wherein the first voice coil or the second voice coil comprises a deformed corner having a shorter z-height than another portion of the first voice coil or the second voice coil.

7. The transducer assembly of claim 1 wherein the support member is a yoke comprising a magnetic material and cut-outs within a portion of the yoke attached to the first magnet and the second magnet, and the cut-outs are dimensioned to allow for thermal or acoustic venting through the yoke.

8. The transducer assembly of claim 1 wherein the support member is positioned between the first magnet and the second magnet, and the support member comprises a vent that vents an acoustic chamber coupled to the first diaphragm and an acoustic chamber coupled to the second diaphragm to an exterior environment.

9. The transducer assembly of claim 1 wherein the transducer is operable to provide a haptic output.

10. A transducer assembly comprising:

a frame;

a dual diaphragm and voice coil assembly suspended from the frame, the dual diaphragm and voice coil assembly having a first diaphragm and a first voice coil attached thereto and a second diaphragm and a second voice coil attached thereto, wherein the first diaphragm and the second diaphragm are operable to move in opposite directions along an axis of vibration and reduce a mechanical force output to the frame;

a magnet assembly positioned within the frame between the first diaphragm and the second diaphragm, the magnet assembly having at least one of a first magnet or a second magnet positioned radially inward to the first voice coil or the second voice coil, and forming a single magnetic return path for a magnetic field used to drive a movement of both the first voice coil and the second voice coil along the axis of vibration; and a support member attaching the magnet assembly to the frame, the support member having a number of extension members that extend from the magnet assembly to the frame.

11. The transducer assembly of 10 wherein the magnet assembly comprises the first magnet and the second magnet, and the first magnet and the second magnet are polarized in a same direction.

12. The transducer assembly of claim 10 wherein the magnet assembly comprises the first magnet having a first plate attached thereto, the second magnet having a second plate attached thereto, the first magnet and the second magnet positioned on opposite sides of the support member, and a ring yoke surrounding the first magnet and the second magnet.

13. The transducer assembly of claim 12 wherein the extension members of the support member extend through openings in the ring yoke to the frame.

14. The transducer assembly of claim 12 wherein the support member comprises a lower z-height than the first magnet and the support member comprises a lower z-height than the second magnet.

15. The transducer assembly of claim 10 wherein the support member comprises a non-magnetic material.

16. The transducer assembly of claim 10 wherein at least one of the first voice coil and the second voice coil comprises a deformed portion having a z-height that is less than a z-height of another portion of the first voice coil or the second voice coil.

17. A transducer assembly comprising:

a frame;

a dual diaphragm and voice coil assembly suspended from the frame, the dual diaphragm and voice coil assembly having a first diaphragm and a first voice coil attached thereto and a second diaphragm and a second voice coil attached thereto, wherein the first voice coil and the second voice coil are attached to interfacing surfaces of the first diaphragm and the second diaphragm; and a magnet assembly positioned between the first diaphragm and the second diaphragm, the magnet assembly comprising a plurality of magnets that form a first gap horizontally aligned with a second gap, and the first voice coil is axially aligned with the first gap and the second voice coil is axially aligned with the second gap.

18. The transducer assembly of claim 17 wherein the plurality of magnets comprise at least two magnets having opposite polarities.

19. The transducer assembly of claim 17 wherein each magnet of the plurality of magnets are horizontally aligned.

20. The transducer assembly of claim 17 wherein the first voice coil is a different size than the second voice coil.

* * * * *